United States Patent [19]

Hall

[11] Patent Number: 4,551,873

[45] **Date of Patent: * Nov. 12, 1985**

[54] WATERBED MATTRESS WITH A BAFFLE

[75] Inventor: Charles P. Hall, Muir Beach, Calif.

[73] Assignee: Monterey Manufacturing Co., Carson, Calif.

[ * ] Notice: The portion of the term of this patent subsequent to Feb. 3, 1998 has been disclaimed.

[21] Appl. No.: 397,795

[22] Filed: Jul. 13, 1982

Related U.S. Application Data

[63] Continuation of Ser. No. 95,214, Nov. 19, 1979, Pat. No. 4,345,348, which is a continuation-in-part of Ser. No. 949,963, Oct. 10, 1978, Pat. No. 4,247,962.

[51] Int. Cl.[4] ..... A47C 27/08

[52] U.S. Cl. ..... 5/450; 5/451

[58] Field of Search ..... 5/451, 452, 455, 450, 5/457, 458, 422

[56] References Cited

U.S. PATENT DOCUMENTS

| | | | |
|---|---|---|---|
| 1,371,919 | 3/1921 | Mahony | 5/455 |
| 2,604,641 | 7/1952 | Reid | 5/455 |
| 3,600,726 | 8/1971 | Williams | 5/451 |
| 3,732,585 | 5/1973 | Krehbiel | 5/451 |
| 3,736,604 | 6/1973 | Carson, Jr. | 5/451 |
| 3,748,669 | 7/1973 | Warner | 5/450 |
| 3,772,717 | 11/1973 | Yuen et al. | 5/450 |
| 4,145,780 | 3/1979 | Fogel | 5/451 |
| 4,152,796 | 5/1976 | Fogel | 5/451 |
| 4,168,555 | 9/1979 | Benjamin | 5/452 |
| 4,201,838 | 5/1980 | Goldberg | 428/316.6 |
| 4,204,289 | 5/1980 | Fogel | 5/451 |
| 4,245,361 | 1/1981 | Evanson | 5/451 |
| 4,301,560 | 11/1981 | Fraige | 5/450 |
| 4,332,043 | 6/1982 | Larson | 5/451 |

FOREIGN PATENT DOCUMENTS

| | | | |
|---|---|---|---|
| 387528 | 9/1976 | Sweden | 5/451 |
| 608951 | 2/1979 | Switzerland | 5/451 |

*Primary Examiner*—Alexander Grosz

*Attorney, Agent, or Firm*—Sheldon & Mak

[57] ABSTRACT

A waterbed mattress has an internal horizontally extending baffle surface for reducing wave-like motion of the water in the mattress. The baffle surface is anchored within the mattress, and preferably between the top and bottom walls of the mattress. Preferably, the baffle surface is fabricated of a buoyant material and is anchored to the bottom wall of the mattress with no connection between the baffle surface and the top wall.

35 Claims, 7 Drawing Figures

FIG. 1.
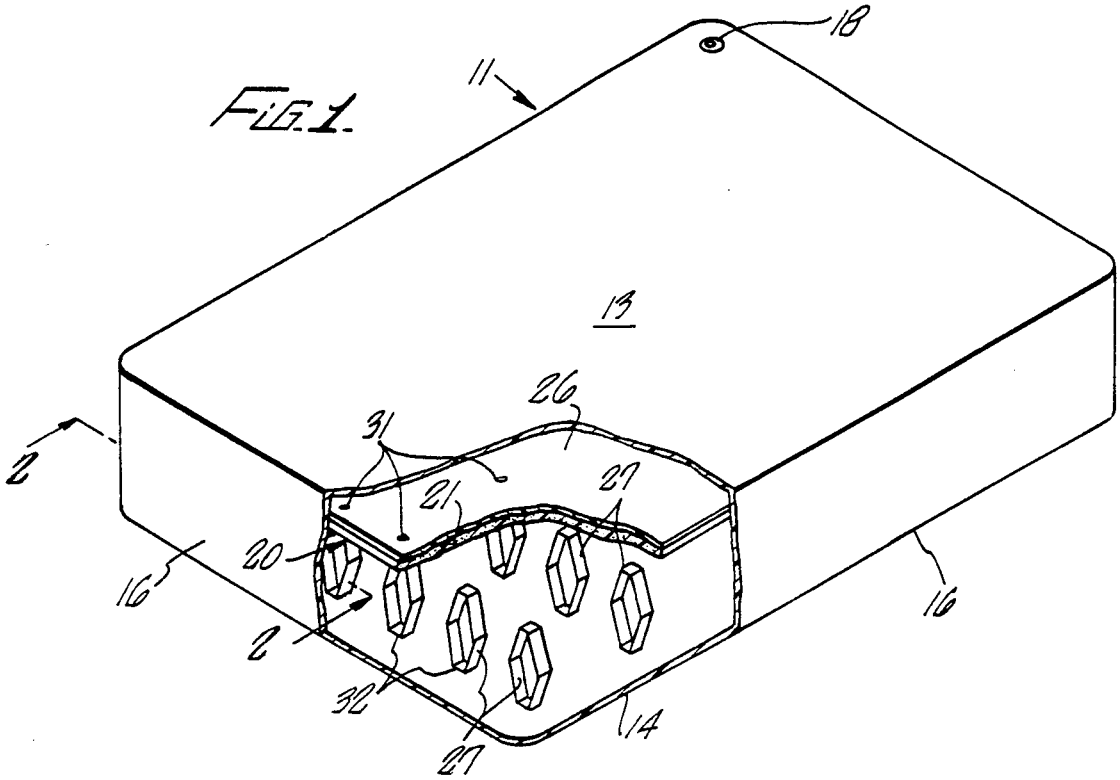
FIG. 2.
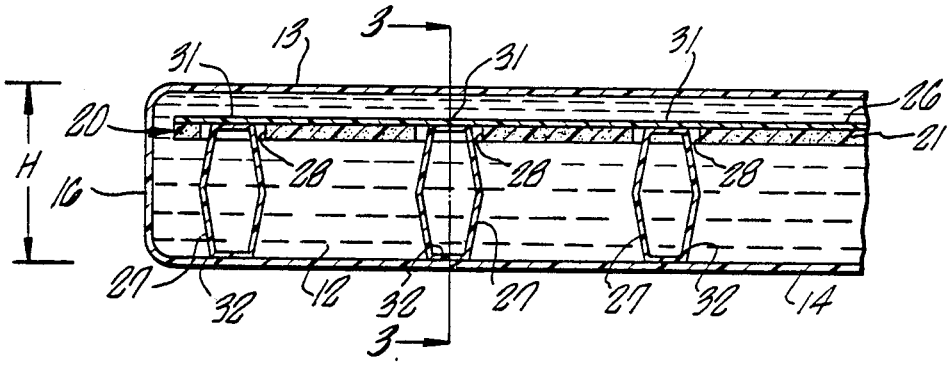
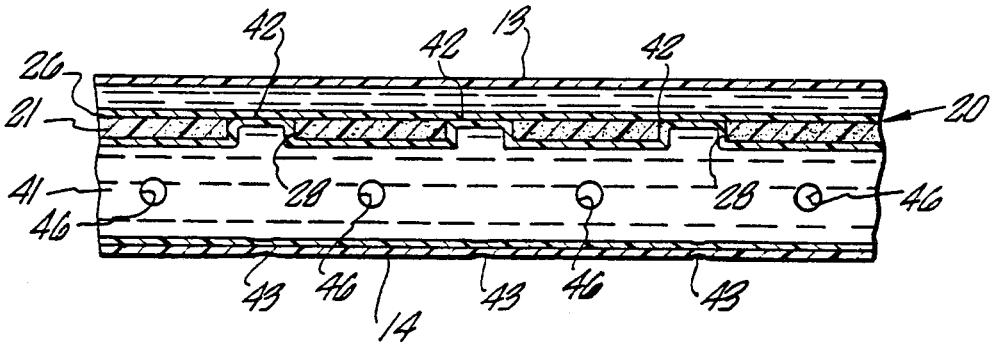
FIG. 3.

18
13
66
68
16

13
27
166
16
14

13
26
20
21
28
16
27
12
110

WATERBED MATTRESS WITH A BAFFLE

CROSS-REFERENCE

This application is a continuation of U.S. patent application Ser. No. 95,214 filed Nov. 19, 1979, now U.S. Pat. No. 4,345,348, which is a continuation-in-part of copending application Ser. No. 949,963, filed on Oct. 10, 1978, now U.S. Pat. No. 4,247,962 which is incorporated herein by this reference.

BACKGROUND

This invention pertains generally to waterbeds, and more particularly to a waterbed mattress having baffle means for preventing excessive undulations of water in the mattress.

Although waterbeds have enjoyed wide popularity in recent years, some persons are disturbed by the wave-like motion or undulations of the water within the mattress. There have been attempts to reduce the water movement, for example, by employing vertical extending baffles inside the mattress. For example, Carson in U.S. Pat. No. 3,736,604 describes a waterbed mattress having perforated, freely swingable vertical flaps to resist excessive motion of fluid within the mattress. In addition, Fogel in U.S. Pat. No. 4,145,780 describes a waterbed mattress having a baffle dampener comprising an upstanding plastic sheet and a horizontal flotation rod. However, such attempts have not been entirely satisfactory in damping the wave-like motion of the water within the mattress resulting from movement of a person laying on the mattress. Therefore, there is a need for waterbed mattress having means for preventing excessive undulations of the water in the mattress.

SUMMARY

The present invention is directed to a novel waterbed mattress that prevents excessive undulations of water in the mattress. The mattress comprises an enclosing structure that includes a horizontally extending top wall, a horizontally extending bottom wall, and side walls. To minimize undulations of the water in the mattress, a horizontally extending baffle surface is disposed in the enclosing structure. The baffle surface preferably is positioned between the top and bottom walls when the mattress is filled with water. The baffle surface has a horizontal extent corresponding generally to the sleeping surface of the mattress. The baffle surface can be anchored by being attached to the bottom, side, or top walls, or a bouyant baffle can be used where the bouyant baffle is anchored to float below the top wall. Preferably the baffle surface is a pad of buoyant material anchored to the bottom wall of the mattress so that the pad floats between the top and bottom walls.

DRAWINGS

These and other features, aspects, and advantages of the present invention will become better understood with reference to the following description, appended claims, and accompanying drawings where:

FIG. 1 is a perspective view, partly broken away, of a waterbed mattress according to the present invention, where the baffle surface is anchored to the bottom wall of the mattress;

FIG. 2 is a fragmentary sectional view taken along line 2—2 in FIG. 1;

FIG. 3 is a fragmentary cross-sectional view of another version of a waterbed mattress according to the present invention with the baffle surface anchored to the bottom wall, taken in a direction corresponding to section 3—3 in FIG. 2;

DESCRIPTION

Figure 4:
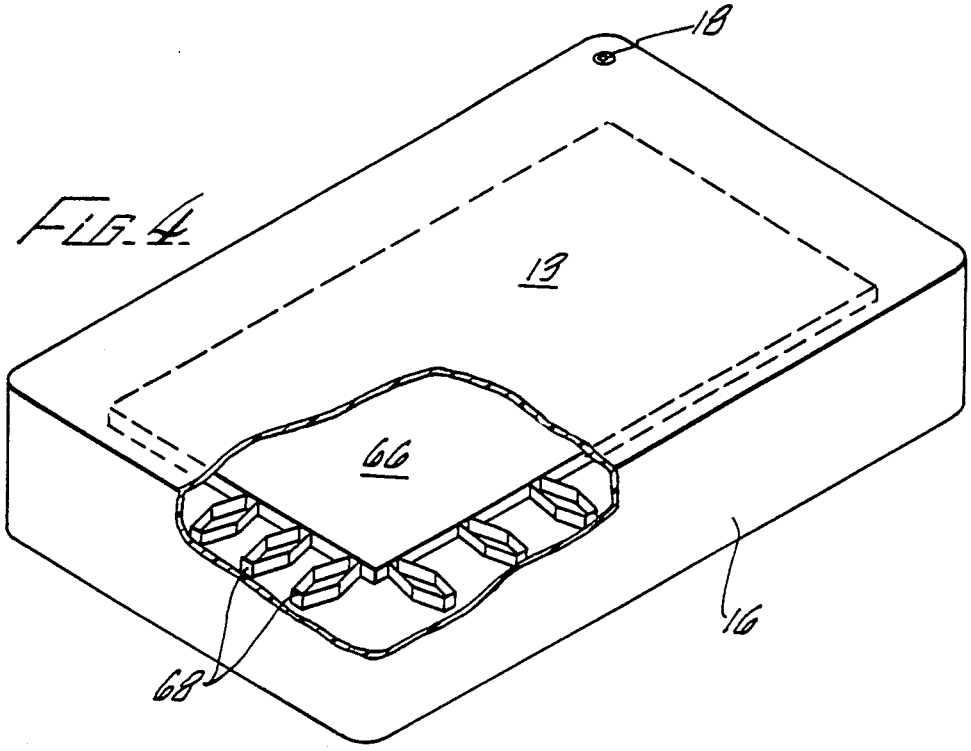
FIG. 4 is a perspective view, partly broken away, of another version of a waterbed mattress according to the present invention where the baffle surface is anchored to the side walls of the mattress.
Figure 5:
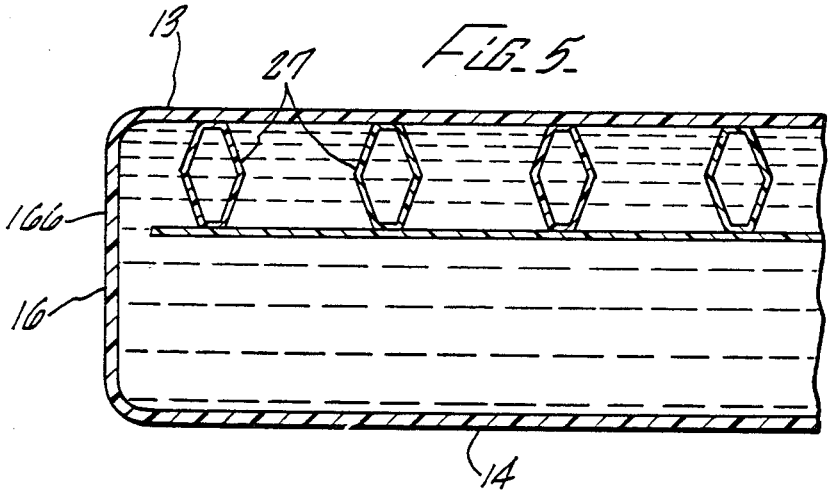
FIG. 5 is a fragmentary sectional view of another version of a waterbed mattress according to the present invention where the baffle surface is anchored to the top wall of the mattress, taken in a directional course corresponding to section line 2—2 in FIG. 1.
Figure 6:
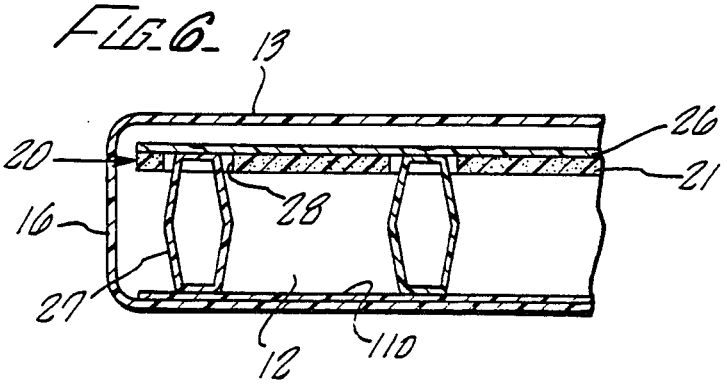
FIG. 6 is a fragmentary sectional view of another version of a waterbed mattress according to the present invention where the baffle surface is not anchored to the mattress, taken in a direction corresponding to section 2—2 in FIG. 1.

The present invention is directed to a waterbed mattress that has significantly less wave-like motion at the surface of the mattress than conventional waterbed mattresses. This novel waterbed mattress has an enclosing structure comprising a horizontally extending top wall, a horizontally extending bottom wall, and side walls. To dampen the wave-like motion, there is a horizontally extending baffle surface disposed within the enclosing structure. Preferably the baffle surface is positioned between the top and bottom walls when the mattress is filled with water. The baffle surface has a horizontal extent corresponding generally to the sleeping surface of the mattress. So that the baffle surface is positioned between the top and bottom walls when the mattress is filled with water, it is anchored to the bottom wall, side walls, and/or top walls of the enclosing structure. Alternatively, a bouyant baffle surface can be weighted down to float between the top and bottom walls. FIGS. 1–3 show versions of the invention where the baffle surface is anchored to the bottom wall. FIG. 4 shows a version of the invention where the baffle surface is anchored to the side walls. FIG. 5 shows a version of the invention where the baffle surface is anchored to the top wall. FIG. 6 shows a version of the invention where the baffle surface is not secured to any of the walls of the mattress, but instead is weighted down to float between the top and bottom walls.

The mattress comprises a generally rectangular enclosing structure 11 containing a body of water 12. The enclosing structure is fabricated of a flexible material such as vinyl and includes a top wall 13, a bottom wall 14, and side walls 16. The top wall is adapted for receiving persons in sitting and reclining positions and is at times referred to as the sleeping surface of the mattress. The enclosing structure can be formed in any suitable manner, for example, by bonding two planar sheets together along their peripheries or by bonding upstanding sheets between the edges of the top and bottom walls to form a contoured or fitted structure. Water is introduced into and removed from the mattress through a valve 18 located toward a corner of the top wall.

As shown in FIGS. 1–3, a horizontally extending baffle surface 20 comprising a pad of buoyant material 21 is positioned within the mattress to reduce the wave-like motion of the water. In one presently preferred embodiment, the pad is fabricated of a closed-cell polyethylene foam, although other suitable materials can be utilized, if desired. In this prefered embodiment, the pad has a thickness on the order of ¼ inch and a horizontal extent slight less than the sleeping area of the mattress. In a king-sized mattress having a sleeping area measuring 84×72 inches, the pad can have a length of 76 inches and a width of 64 inches. Thus, the baffle surface has a horizontal extent corresponding generally to the horizontal extent of the sleeping surface. It is important that the baffle surface have a large horizontal extent to obtain adequate damping of the wave-like motion of the water in the waterbed. To obtain adequate damping, the baffle surface has a horizontal extent such that its surface area is equal to at least about two-thirds of the surface area of the sleeping surface, and more preferably is equal to at least about three-quarters of the surface area of the sleeping surface.

Figure 7:
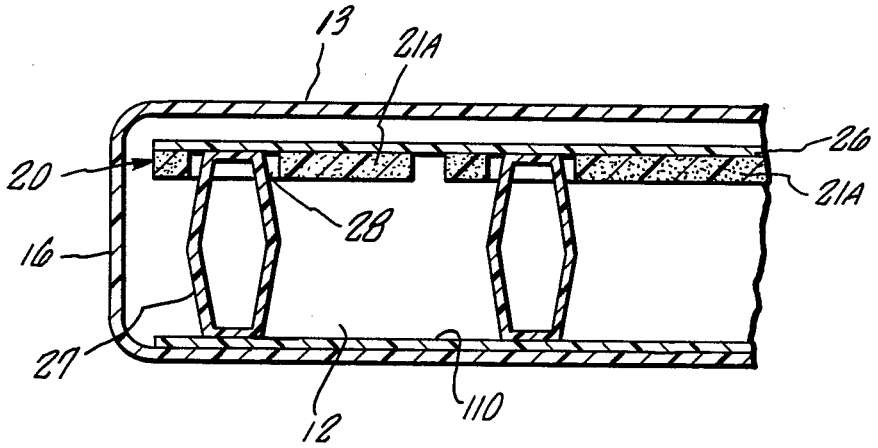
FIG. 7 shows another version of the waterbed mattress of FIG. 6.

If desired, as shown in FIG. 7, a plurality of individual pads can be used as the baffle surface as long as the total surface of the pads is equal to at least about two-thirds of the surface area of the sleeping surface.

Preferably the baffle surface is anchored to the bottom wall of the mattress. This configuration is preferred because when a person rolls over on the waterbed or gets up from the waterbed, water tends to quickly rise to fill in the region vacated by the person. A baffle surface anchored to the bottom wall of the mattress is better able to impede the water from quickly rising than is a baffle surface anchored to the side or top walls of a mattress.

With reference to FIGS. 1 and 2, the means provided for anchoring the pad 21 in a floating position between the top and bottom walls of the mattress includes a flexible sheet 26 and a plurality of flexible straps 27. The flexible sheet overlies the pad, and the straps extend through openings 28 in the pad. As illustrated, the straps are formed as loops which are bonded at the top and bottom to the sheet 26 and the bottom wall 14, at spaced apart points, as indicated at 31, 32. The straps are arranged in rows which extend lengthwise of the mattress, and a king-sized mattress can, for example, have six rows of straps, with eight straps in each row. In this embodiment, the straps are spaced about ten inches apart in either lateral direction, but other strap arrangements and spacings can be utilized, if desired. The straps and overlying sheet 26 are fabricated of a flexible material such as 20 mil vinyl, and the bonds between the straps and the overlying sheet and the bottom wall of the enclosing structure are formed by suitable means such as sonic welding. The straps can be of any suitable width, and in the embodiment of FIGS. 1–2, they are on the order of three inches wide.

The firmness of the mattress is partly dependent upon the vertical position of the buoyant pad within the enclosing structure, with the firmness increasing as the pad is positioned closer to top wall 13. If the baffle surface is too close to either the top or bottom wall, the damping effect of the baffle surface is greatly reduced. Furthermore, if the baffle surface is too close to the top wall 13, the mattress can be too firm for comfortable sleeping. Preferably the baffle surface is anchored so that it is positioned at a vertical distance of from ½H to 15/16H above the bottom wall of the enclosure, where H is the distance between the bottom wall and the top wall when the mattress is filled with water, as shown in FIG. 2. More preferably, the baffle surface is positioned a vertical distance above the bottom wall of from ⅔H to ¾H. Thus, the baffle surface is closer to the top wall than the bottom wall when the mattress is filled with water. With a mattress having a depth of nine inches and a ¼ inch foam pad, a good balance between firmness and wave suppression is provided by anchoring the pad to float about six inches above the bottom wall of the enclosure. The position can be selected to suit the preference of the individual user.

Although it is less preferred, the baffle surface can be in contact with the top wall, such as when a user rests on the mattress.

Openings, not shown, are provided in both the buoyant pad and the overlying sheet to assure good water circulation and heat distribution throughout the mattress and to prevent air from being trapped between the pad and sheet. The openings in the pad are preferably on the order of about 3/8 inch diameter and are spaced about one inch apart over the entire pad. The openings in the overlying sheet can, for example, be three inch slits centered between the points of strap attachment.

In operation and use, the enclosure is filled with water, and the buoyant pad floats between the top and bottom walls at the height determined by the straps. Being anchored to the bottom wall, the pad limits the wave-like motion of the water within the mattress by damping and limiting the amplitude of the waves. Since there is no connection between the pad and the top wall, there is no undesired pulling or tensioning of the top wall as there is in mattresses having vertically extending baffles connected to the top wall.

The embodiment of FIG. 3 is generally similar to that of FIGS. 1–2 except that it has elongated tubular members 41 in place of the individual straps. The tubular members 41 are fabricated of a flexible material such as vinyl and are affixed at spaced apart points 42, 43 to the sheet 26 and the bottom wall 14. Each tubular member corresponds to one row of straps, and a king-sized mattress can, for example, have six tubular members positioned side-by-side and extending lengthwise within the mattress. The tubular members are bonded to the sheet 26 through openings 28 in the buoyant pad. The ends of the tubular members are open, and vent holes 46 are formed in the side walls of the members to permit water circulation. In one preferred embodiment, vent holes having a diameter on the order of three inches are spaced about ten inches apart along the tubes.

Operation and use of the embodiment of FIG. 3 is similar to that described above in connection with FIGS. 1–2.

With reference to FIG. 4, the baffle surface comprises a flexible sheet 66, substantially identical to the flexible sheet 26 used for anchoring the buoyant pad 21. Because the flexible sheet 66 is anchored to the side wall 16, it need not be buoyant and can have a specific gravity greater than 1.0. Means are provided for anchoring the flexible sheet to the side walls in a floating position between the top and bottom walls of the mattress. In FIG. 4, the anchoring means comprise a plurality of flexible straps 68 formed as loops which are bonded at one end to the sheet 66 and at the other end to a side wall 16. The straps are arranged around the entire periphery of the sheet 66 and can be spaced apart about ten inches from each other, although other strap arrangements and spacings can be utilized, if desired.

Openings, not shown, are provided in the flexible sheet 66 to assure good water circulation and heat distribution throughout the mattress. If desired, the flexible sheet 66 can be made from a buoyant material.

In the version of the invention shown in FIG. 5, the baffle surface again is a flexible sheet 66. The sheet 66 needs to be denser than water so that it does not float up to the top surface. The sheet is anchored to the top surface by straps 27 identical to the straps used in the version of the invention shown in FIGS. 1–2. The straps are formed as loops which are bonded at the top to the top surface 13 and at the bottom to the flexible sheet 66. The same types of arrangements that can be used in the version of the invention shown in FIGS. 1 and 2 can be used for anchoring the sheet 66 to the top surface 13. In addition, the tubular members 41 used in the version of the invention shown in FIG. 3 can be used for anchoring the sheet 66 to the top surface 13.

The version of the invention shown in FIG. 6 is substantially identical to the version shown in FIGS. 1 and 2, except the straps 27 are not bonded to the bottom wall 14. Instead the straps 27 are bonded to a separate, flexible, horizontally extending anchor sheet 110 of vinyl. The anchor sheet 110 serves to anchor the buoyant pad 21 in a floating position between the top and bottom walls of the mattress. An advantage of this version of the invention is that it is not necessary to attach the baffle structure to the enclosing structure. Thus, there are no stresses on the enclosing structure which could lead to a weakening of the wall and formation of a water leak.

The version of the invention shown in FIG. 7 is substantially identical to the version shown in FIG. 6 except that the pad 21 is replaced with a plurality of individual pads 21A.

Other anchoring systems can be used. For example, fishing weights can be secured to the straps and the straps themselves can be made of dense heavy plastic.

Although the present invention has been described with considerable detail with regard to certain versions thereof, other versions are possible. For example, the baffle surface need not be anchored solely to the top, bottom or side walls of a mattress. Instead, the baffle surface can be anchored to both the top and bottom walls, the top and side walls, the side and bottom walls, or the top, bottom and side walls. Furthermore, more than one horizontally extending baffle surfaces can be provided in a single waterbed mattress with the baffle surfaces at different elevations or at the same elevation. Therefore, the spirit and scope of the appended claims should not necessarily be limited to the description of the preferred versions contained herein.

What is claimed is:

1. An improved waterbed mattress of a type having a flexible water-filled bladder in which said bladder has a recloseable opening for adding and removing water and air from said bladder wherein the improvement comprises:

(a) at least one buoyant, flexible, foam, horizontal plate member, located inside said bladder and unattached to any surface of said bladder;

(b) appendages depending from the lower surface of said horizontal member, wherein said appendages have vertically inclined faces extending to a depth of at least half the distance to the bottom wall of said bladder; and (c) attachment means for attaching said appendages to said horizontal member.

2. The waterbed mattress as described in claim 1, wherein said appendages and attachment means are unattached to any surface of said bladder.

3. An improved waterbed mattress of a type having a flexible water-filled bladder in which said bladder has a recloseable opening for adding and removing water and air from said bladder wherein the improvement comprises:

(a) at least one buoyant, flexible, foam, horizontal plate member, located inside said bladder and unattached to any surface of said bladder;

(b) appendages depending from the lower surface of said horizontal member, wherein said appendages comprise straps having vertically inclined faces extending to a depth of at least half the distance to the bottom wall of said bladder; and (c) attachment means for attaching said appendages to said horizontal member.

4. The waterbed mattress as described in claim 3 wherein said appendages and attachment means are unattached to any surface of said bladder.

5. A waterbed mattress having (i) an enclosing structure comprising a horizontally extending top wall and a horizontally extending bottom wall, and (ii) a baffle structure comprising:

(a) a buoyant horizontal baffle disposed within the enclosing structure and spaced apart from the bottom wall of the mattress for limiting motion of water in the mattress, the horizontal baffle having a horizontal extent corresponding substantially to the horizontal extent of the top wall of the mattress and comprising at least one pad of buoyant material; and (b) a plurality of flexible depending members positioned below the horizontal baffle and extending downwardly from the horizontal baffle toward the bottom wall of the mattress, the depending members being made of a plastic material denser than water.

6. The mattress of claim 5 wherein the horizontal baffle includes a flexible sheet overlying the buoyant material, and wherein the depending members are connected to the flexible sheet.

7. The waterbed mattress of claim 6 wherein the depending members comprise a plurality of flexible straps.

8. The waterbed mattress of claim 6 wherein the depending members comprise a plurality of elongated tubular members affixed longitudinally to the flexible sheet.

9. The waterbed mattress of claim 6 wherein the depending members and the flexible sheet are made of vinyl.

10. The waterbed mattress of claim 5 wherein the horizontal baffle comprises a plurality of pads of buoyant material.

11. The waterbed mattress of claim 5 wherein the surface area of the horizontal baffle is at least $\frac{2}{3}$ the surface area of the top wall of the mattress.

12. The waterbed mattress of claim 5 wherein the buoyant material is polymeric foam.

13. A waterbed mattress having (i) an enclosing structure comprising a horizontally extending top wall and a horizontally extending bottom wall, and (ii) a free floating baffle structure unattached to the enclosing structure comprising:

(a) a buoyant horizontal baffle disposed within the enclosing structure and spaced apart from the bottom wall of the mattress for limiting motion of water in the mattress, the horizontal baffle having a horizontal extent corresponding substantially to the horizontal extent of the top wall of the mattress and comprising at least one pad of buoyant material;

(b) a horizontally extending flexible sheet made of a plastic material denser than water and underlying the horizontal baffle and spaced apart therefrom; and (c) a plurality of flexible depending members positioned below the horizontal baffle and extending downwardly from the horizontal baffle toward the bottom wall of the mattress, wherein the depending members are made of a flexible plastic material denser than water and are attached to the underlying flexible sheet.

14. The mattress of claim 13 wherein the horizontal baffle comprises a flexible sheet overlying the buoyant material and wherein the depending members are also connected to the overlying flexible sheet.

15. The waterbed mattress of claim 14 wherein the depending members comprise a plurality of flexible straps.

16. The waterbed mattress of claim 14 wherein the depending members comprise a plurality of elongated tubular members affixed longitudinally to the overlying flexible sheet.

17. The waterbed mattress of claim 14 wherein the depending members, the overlying flexible sheet, and the underlying flexible sheet are made of vinyl.

18. The waterbed mattress of claim 13 wherein the horizontal baffle comprises a plurality of pads of buoyant material.

19. The waterbed mattress of claim 13 wherein the surface area of the horizontal baffle is at least $\frac{2}{3}$ the surface area of the top wall of the mattress.

20. The waterbed mattress of claim 13 wherein the buoyant material is polymeric foam.

21. A waterbed mattress having (i) an enclosing structure comprising a horizontally extending top wall and a horizontally extending bottom wall, and (ii) a baffle structure comprising:

(a) a buoyant horizontal baffle disposed within the enclosing structure spaced apart from the bottom wall of the mattress for limiting motion of water in the mattress, the horizontal baffle having a horizontal extent corresponding substantially to the horizontal extent of the top wall of the mattress and comprising at least one pad of buoyant polymeric foam; and (b) a plurality of depending members made of a flexible plastic material denser than water and positioned below the horizontal baffle, the depending members extending downwardly from the horizontal baffle toward the bottom wall of the mattress and dividing the volume in the enclosing structure into segments, the depending members having holes therethrough for water circulation into and out of the segments.

22. The mattress of claim 21 wherein the horizontal baffle includes a flexible sheet overlying the buoyant foam and wherein the depending members are connected to the overlying flexible sheet.

23. The waterbed mattress of claim 21 wherein the depending members are made of vinyl.

24. The waterbed mattress of claim 21 wherein the surface area of the horizontal baffle is at least $\frac{2}{3}$ the surface area of the top wall of the mattress.

25. The waterbed mattress of claim 21 wherein the horizontal baffle comprises a plurality of pads of buoyant polymeric foam.

26. The waterbed mattress of claim 21 in which the segments are generally tubular and are open at both ends.

27. A waterbed mattress having (i) an enclosing structure comprising a horizontally extending top wall and a horizontally extending bottom wall, and (ii) a free floating baffle structure unattached to the enclosing structure comprising:

(a) a buoyant horizontal baffle disposed within the enclosing structure and spaced apart from the bottom wall of the mattress for limiting motion of water in the mattress, the horizontal baffle having a horizontal extent corresponding substantially to the horizontal extent of the top wall of the mattress and comprising at least one pad of buoyant polymeric foam;

(b) a horizontally extending flexible sheet made of a plastic material denser than water and underlying the horizontal baffle and spaced apart therefrom; and (c) a plurality of depending members made of a flexible plastic material denser than water and positioned below the horizontal baffle, the depending members extending downwardly from the horizontal baffle toward the bottom wall of the mattress and dividing the volume in the enclosing structure into segments, wherein the depending members have holes therethrough for water circulation into and out of the segments and are connected to the underlying flexible sheet.

28. The mattress of claim 27 wherein the horizontal baffle includes another flexible sheet overlying the buoyant foam and wherein the depending members are connected to the overlying flexible sheet.

29. The waterbed mattress of claim 28 wherein the depending members, the underlying flexible sheet, and the overlying flexible sheet are made of vinyl.

30. The waterbed mattress of claim 27 wherein the surface area of the horizontal baffle is at least $\frac{2}{3}$ the surface area of the top wall of the mattress.

31. The waterbed mattress of claim 27 in which the segments are generally tubular and are open at both ends.

32. A waterbed mattress having (i) an enclosing structure comprising a horizontally extending top wall and a horizontally extending bottom wall, and (ii) a free floating baffle structure unattached to the enclosing structure comprising:

(a) a buoyant horizontal baffle disposed within the enclosing structure and spaced apart from the bottom wall of the mattress for limiting motion of water in the mattress, the horizontal baffle having a horizontal extent corresponding substantially to the horizontal extent of the sleeping surface of the mattress, the surface area of the horizontal baffle being at least $\frac{2}{3}$ the surface area of the top wall, the horizontal baffle comprising a plurality of pads of buoyant polymeric foam and a flexible sheet made of a plastic material denser than water overlying the pads of foam;

(b) a flexible polymeric sheet made of a plastic material denser than water underlying the horizontal baffle and spaced apart therefrom; and (c) a plurality of depending members made of a flexible plastic material denser than water and positioned below the horizontal baffle, the depending members extending downwardly from the horizontal baffle toward the bottom wall of the mattress, the depending members being secured to the overlying and the underlying flexible sheets and dividing the volume in the enclosing structure into segments, the depending members having holes therethrough for water circulation into and out of the segments.

33. A waterbed mattress having (i) an enclosing structure comprising a horizontally extending top wall and a horizontally extending bottom wall, and (ii) a baffle structure comprising a buoyant horizontal baffle disposed within the enclosing structure and spaced apart from the bottom wall of the mattress for limiting motion of water in the mattress, the horizontal baffle having a horizontal extent corresponding substantially to the horizontal extent of the top wall of the mattress and comprising at least one pad of buoyant closed cell foam and a flexible sheet overlying and in direct contact with buoyant material, the flexible sheet being made of a plastic material denser than water, the mass of the buoyant material being sufficient so that the horizontal baffle floats spaced apart from the bottom wall.

34. The waterbed mattress of claim 31 wherein the horizontal baffle comprises a plurality of pads of buoyant material.

35. The waterbed mattress of claim 31 wherein the horizontal baffle comprises a single pad of buoyant material.

* * * * *